US010737707B2

(12) United States Patent
Kukulski et al.

(10) Patent No.: US 10,737,707 B2
(45) Date of Patent: Aug. 11, 2020

(54) IMPACT ENERGY ABSORBER

(71) Applicant: AXTONE SPOLKA AKCYJNA, Kanczuga (PL)

(72) Inventors: Jan Kukulski, Kosina (PL); Leszek Wasilewski, Gniewczyna (PL)

(73) Assignee: Axtone Spolka Akcyjna (PL)

( * ) Notice: Subject to any disclaimer, the term of this patent is extended or adjusted under 35 U.S.C. 154(b) by 355 days.

(21) Appl. No.: 15/555,844

(22) PCT Filed: Mar. 2, 2016

(86) PCT No.: PCT/IB2016/051174
§ 371 (c)(1),
(2) Date: Sep. 5, 2017

(87) PCT Pub. No.: WO2016/139596
PCT Pub. Date: Sep. 9, 2016

(65) Prior Publication Data

US 2018/0043911 A1 Feb. 15, 2018

(30) Foreign Application Priority Data

Mar. 5, 2015 (PL) ..... 411483

(51) Int. Cl.
*B61G 11/16* (2006.01)

(52) U.S. Cl.
CPC ..... *B61G 11/16* (2013.01)

(58) Field of Classification Search
CPC ..... B61G 11/16
USPC ..... 213/9
See application file for complete search history.

(56) References Cited

U.S. PATENT DOCUMENTS 4,346,795 A * 8/1982 Herbert ..... B61G 9/10 188/375
5,597,055 A * 1/1997 Han ..... F16F 7/126 188/371
6,019,419 A * 2/2000 Browne ..... B62D 21/152 180/274
7,357,445 B2 * 4/2008 Gross ..... B62D 21/152 188/377

(Continued)

FOREIGN PATENT DOCUMENTS

CN 2220392 Y 2/1996
CN 101801757 A 8/2010

(Continued)

OTHER PUBLICATIONS

Indian Examination Report for IN 201737019165; dated Aug. 14, 2019; 6 pages.

(Continued)

*Primary Examiner* — Jason C Smith
(74) *Attorney, Agent, or Firm* — Barclay Damon LLP

(57) ABSTRACT

The device contains an energy absorbing element in a form of at least two parallel machinable rods placed at a distance from one another, and at least one thrust element used to transmit a tractive force between the machining unit and the rods. The device also features a tool mounting plate, forming a part of the machining unit, seated on the rods via guiding holes. A mounting plate is fastened on the rods and placed at a distance from the tool mounting plate.

15 Claims, 8 Drawing Sheets

(56) References Cited

U.S. PATENT DOCUMENTS

| | | | | |
|---|---|---|---|---|
| 2009/0065462 | A1* | 3/2009 | Gansweidt | B61G 7/10 213/1 A |
| 2013/0270210 | A1* | 10/2013 | Kukulski | B61G 9/10 213/62 R |
| 2014/0326553 | A1* | 11/2014 | Parida | B61G 11/12 188/268 |
| 2016/0152247 | A1* | 6/2016 | Sano | B61D 15/06 105/392.5 |
| 2017/0254382 | A1* | 9/2017 | Kukulski | F16F 9/3214 |
| 2017/0361855 | A1* | 12/2017 | Kukulski | B61G 11/18 |
| 2018/0043911 | A1* | 2/2018 | Kukulski | B61G 11/16 |

FOREIGN PATENT DOCUMENTS

| | | | |
|---|---|---|---|
| CN | 102107664 | A | 6/2011 |
| CN | 102180182 | A | 9/2011 |
| DE | 101 45 446 | A1 | 3/2002 |
| EP | 1 759 958 | B1 | 1/2009 |
| GB | 860691 | | 2/1961 |
| JP | 2015-30295 | A | 2/2015 |
| NL | 7 502 142 | A | 8/1976 |
| PL | 202114 | B1 | 6/2005 |
| PL | 211405 | B3 | 8/2007 |
| PL | 392966 | A1 | 5/2012 |
| PL | 401424 | A1 | 5/2014 |
| WO | WO 2015/15747 | A1 | 2/2015 |

OTHER PUBLICATIONS

International Search Report and Written Opinion for PCT/IB2016/051174; dated Jul. 7, 2017; 8 pages.
Polish Search Report for P-411483; dated Mar. 23, 2015; 1 page.
Indian Examination Report for IN 201737025904; dated Jul. 22, 2019; 6 pages.

* cited by examiner

IMPACT ENERGY ABSORBER

CROSS REFERENCE TO RELATED APPLICATIONS

This application is a national stage application under 35 U.S.C. § 371 of International Application No. PCT/IB2016/051174, filed Mar. 2, 2016, which claims priority of Polish Patent Application No. P.411483, filed Mar. 5, 2015, the entire contents of each application being herein incorporated by reference.

TECHNICAL FIELD

The present invention refers to a device which absorbs impact energy in structural units connecting rail vehicles.

BACKGROUND

Patent specification PL202114 presents an impact energy absorber consisting of a rod which can be machined by cutting tools surrounding it, placed evenly in a body sleeve. In order to ensure the correct guiding of the cutting tools, their blades are placed in guides shaped on the outer surface of the rod.

Patent specification PL211405 also presents an impact energy absorber consisting of a rod of a fluently changing diameter, which can be machined by cutting tools. In particular, this rod has a conical, pyramidal or another curvilinear shape in order to provide an increased energy absorption capacity in case of impact involving high kinetic energy.

Known devices perform well their task of absorbing the kinetic energy of impacts but they are unsuitable for a direct application as devices which transmit axial forces, alternating compressive and tensile ones.

BRIEF DESCRIPTION

The purpose of the invention is to develop a device absorbing the impact energy by means of machining, which device has an increased modulus of rigidity, transmits tractive forces, impact forces and increased lateral forces, and at the same time has a simple construction.

According to the invention, the impact energy absorber in rail vehicle units has:

- an energy absorbing element selected parts of which are machinable,
- cutting tools surrounding the energy absorbing element, fastened in the machining unit movable parallel to the axes of the selected parts of the energy absorbing element,
- at least one safety intermediate element which ensures the integrity of the connection between the energy absorbing element and the machining unit to a set threshold value of the impact force and allows an axial movement of the machining unit relative to the energy absorbing element when the set threshold value of the impact force has been exceeded.

The invention is characterized in that it comprises

- an energy absorbing element comprising a set of at least two parallel machinable rods placed at a distance from one another,
- at least one thrust element used to transmit the tractive force between the machining unit and the rods,
- a tool mounting plate forming a part of the machining unit, seated on the rods through guiding holes, and

- a mounting plate fastened to the rods, placed at a distance from the tool mounting plate.

Preferably, the thrust element is in contact with the machining unit and has a form of a thrust ring fastened to the end part of the rod.

Preferably, the thrust element is united with the safety intermediate element coupled with the machining unit, and the safety intermediate element is a threaded sleeve.

Preferably, the machining unit has a sleeve guiding part united with the tool mounting plate.

Preferably, the safety intermediate element has a threaded connection with the end part of the sleeve guiding part of the machining unit.

Preferably, there is an annular undercut between the thrust element and the safety intermediate element.

Preferably, the thrust ring has at least one recess on its circumference.

Preferably, the thrust ring is welded to the end part of the rod.

Preferably, the mounting plate is placed parallel to the tool mounting plate, and both mounting plates are seated on the opposite ends of the rods.

Preferably, the mounting plate is seated on the rod by means of a threaded connection.

Preferably, the rods are set perpendicularly to the mounting plate and to the tool mounting plate.

Preferably, the mounting plate is adapted to being connected with a joint of a bogie supporting two neighbouring rail carriages, and the tool mounting plate is adapted to being connected with a carbody load-bearing structure.

Preferably, the mounting plate and the tool mounting plate are substantially rectangular in shape.

The execution of the energy absorbing element as two parallel rods placed at a distance from one another and connected with the mounting plates also placed at a distance from one another allows to achieve the structure with an increased modulus of rigidity which is capable of transmitting greater lateral forces acting in the extreme operating conditions of the device. Such a solution allows a movement of the tool mounting plate in a perpendicular direction relative to the rods, influencing the even operation of the cutting tools.

Using a thrust element between the machining unit and the rods to transmit the tractive force allows to use the device of the invention also in the function of a coupler assembly. To this end, the device comprises also a tool mounting plate which facilitates fastening of the device of the invention to cooperating, neighbouring elements of a rail carriage on one side of the rod. On the other side of the rod, the device according to the invention is mounted to the cooperating, neighbouring elements of a rail carriage via a second mounting plate fastened at a distance from the tool mounting plate. Fastening of both plates on the rods at a distance from one another allows their movement towards each other when the pre-set threshold value of the impact force has been exceeded.

Execution of the thrust element in the form of a thrust ring fastened in the end part of the rod facilitates the assembly of the device according to the invention. Such a structure simplifies also the construction of one combined element wherein the thrust element is coupled with the safety intermediate element.

The sleeve guiding part provides an axial guiding of the tool mounting plate with the cutting tools along the rods in the situation after a break of the safety intermediate element.

The annular undercut made at the connection between the thrust element and the safety intermediate element defines the place wherein the safety intermediate element is torn away from the thrust ring when the pre-set threshold value of the impact force has been exceeded.

BRIEF DESCRIPTION OF THE DRAWINGS

The invention is presented in its embodiment in the drawing, where.

DETAILED DESCRIPTION

Figure 1:
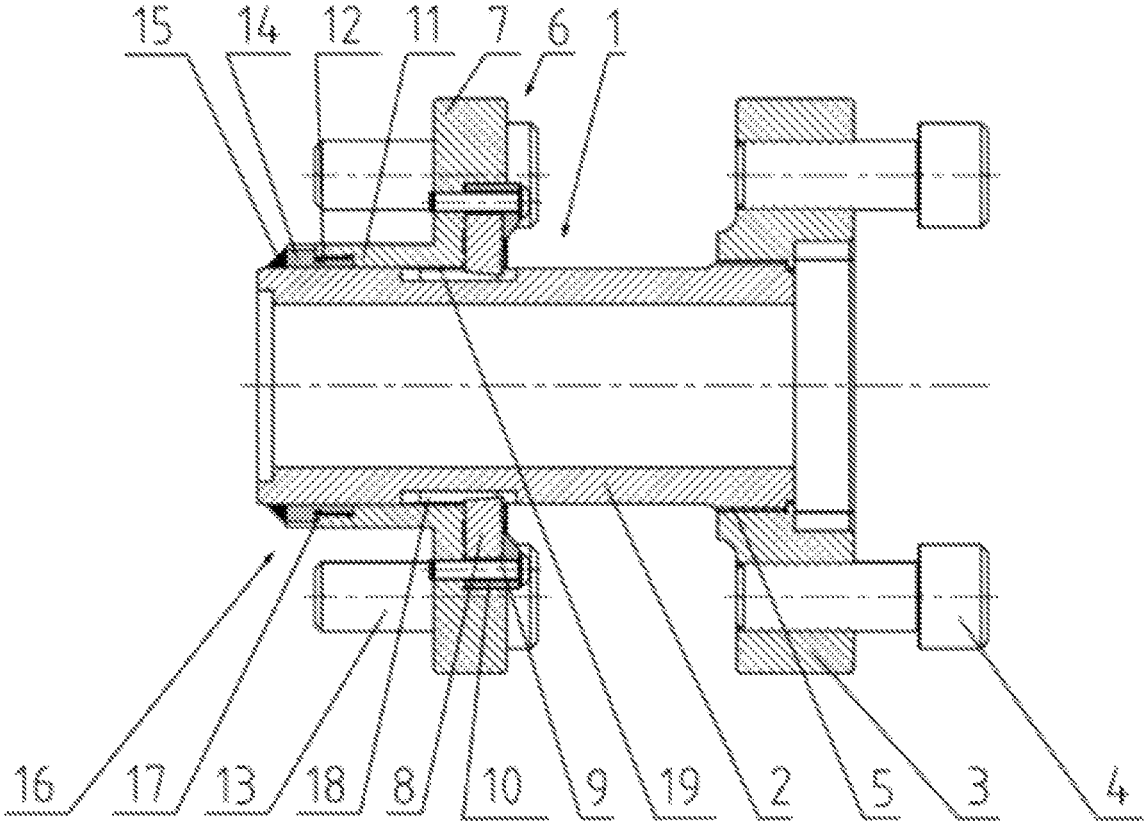
FIG. 1 presents the impact energy absorber according to the invention at rest, before impact, in axial section.
Figure 2:
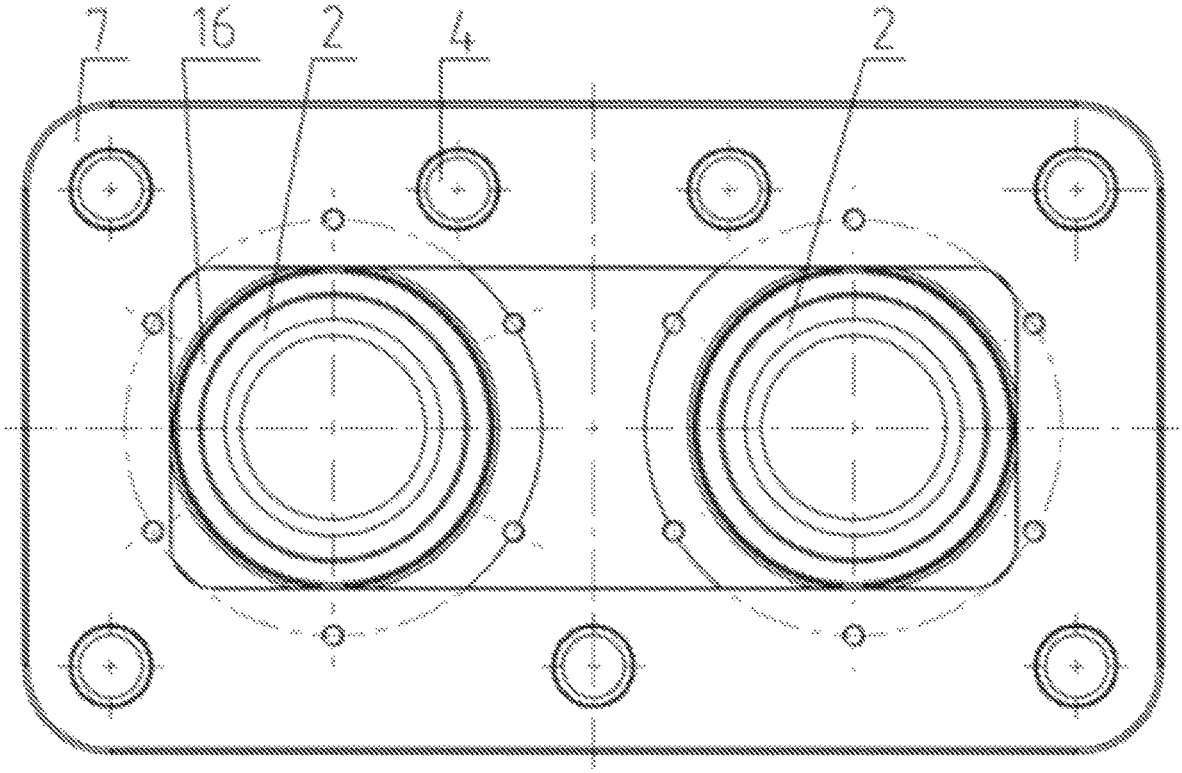
FIG. 2 presents the impact energy absorber from the side of the tool mounting plate.

As presented in the embodiment in FIG. 1 and FIG. 2, the impact energy absorber for structural units connecting rail carriages according to the invention comprises an energy absorbing element 1 which is a set of two steel rods 2 made in the form of machinable sleeves or bars. At one end of each rod 2 there is fastened a mounting plate 3 with bolts 4 which connects the device of the invention with structural units connecting rail carriages. The connection between the mounting plate 3 and the rods 2 is a robust threaded connection 5 which is capable of transmitting both the tractive force and the impact force. This connection is to prevent the shift of the mounting plate 3 relative to the rod 2 at any load conditions. In the vicinity of the other end of each rod 2 there is a machining unit 6 comprising a tool mounting plate 7 with cutting tools 8 placed in the recesses and pressed by bolts 9 via pressure elements 10. The tool mounting plate 7 is fastened to the rods 2 via a sleeve guiding part 11 by means of safety intermediate elements 12 capable of breaking at the action of pre-set impact force. The tool mounting plate 7 can be connected with the structural unit of the rail carriage by means of bolts 13. The safety intermediate elements 12 have a shape of sleeves loosely surrounding the surface of the rods 2, and each of the safety intermediate elements 12 is united with the thrust ring 14 durably connected by a welded joint 15 with the end surface of the rod 2.

The thrust ring 14 connected by the welded joint 15 with the rod 2 constitutes the thrust element 16. The task of this thrust element 16 is to transmit the pressure of the sleeve guiding part 11 caused by the tractive force. Moreover, the thrust element 16 should not be destroyed at any impact force. When the threshold value of the impact force is reached, which initiates the absorption of kinetic energy by the device of the invention, only the safety intermediate element 12 gets damaged. In the embodiment presented in FIG. 1, the damage of the safety intermediate element 12, in the form of a ruptured connection between the rod 2 and the sleeve guiding part 11 of the machining unit 6, can involve breaking of the sleeve guiding part 11 in the vicinity of the thrust ring 14, in the location where this safety intermediate element 12 has the least tensile strength, which in practice is the place where its cross-section is the smallest. In an alternative solution, the integrity limit of connection between the rod 2 and the machining unit 6 can be determined by the shear strength of a thread 17 of the safety intermediate element 12. Before breaking of the safety intermediate element 12, the blades of cutting tools 8 are placed in the set position in guiding undercuts 18 formed on the side surface of the rod 2. A part of the rods 2 between the guiding undercuts 18 and the mounting plate 3 has a hardness appropriately selected to be machinable with the cutting tools 8 and to ensure an optimized absorption of kinetic energy of the impact. During the machining, the cutting tools 8 are guided parallel to the axes of selected parts of the rods 2.

The tool mounting plate 7 is parallel to the mounting plate 3, both before and after breaking of the safety intermediate element 12. The parallel guiding of the tool mounting plate 7 after breaking of the safety intermediate element is a result of a slide mounting of the perpendicular rods 2 in guiding holes 19 of the tool mounting plate 7.

Figure 3:
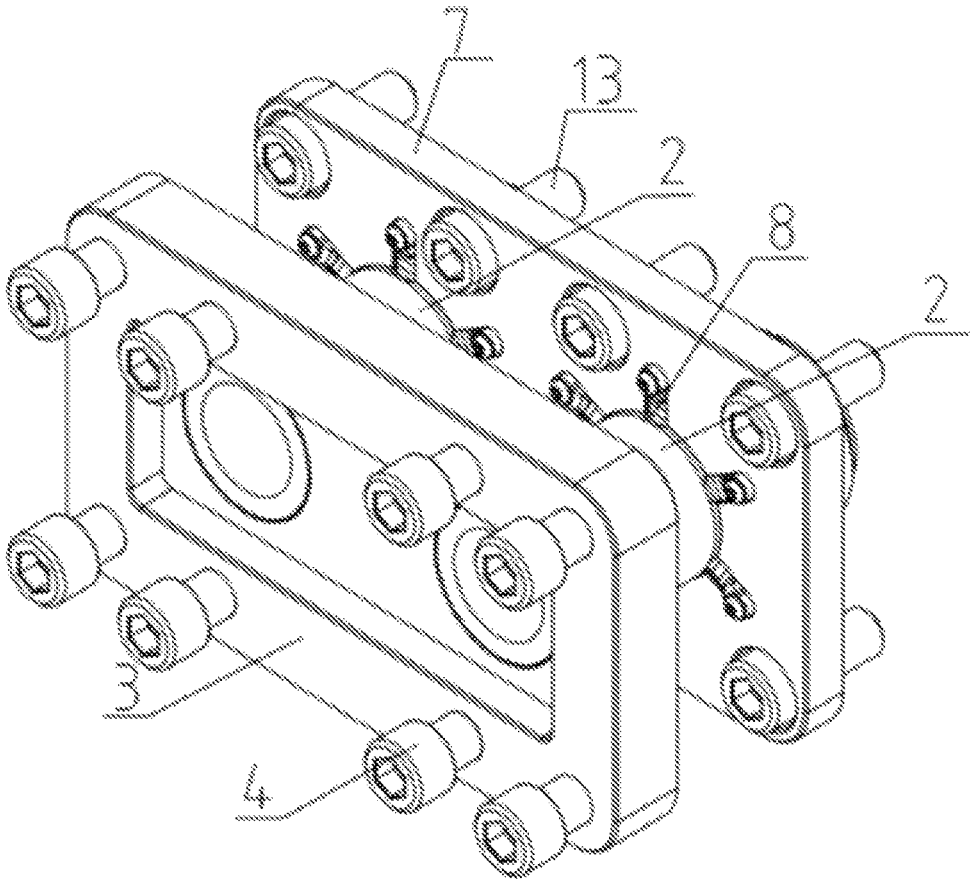
FIG. 3 presents a perspective view of the impact energy absorber.

As shown in FIG. 3, the mounting plate 3 and the tool mounting plate 7 are mounted on two cylindrical rods 2 placed at a distance from one another. The rods 2 are parallel to each other, wherein after fastening them to the cooperating structural units of rail carriages the axes of the rods 2 are in the horizontal plane. Such connection of the mounting plates 3, 7 and the rods 2 makes up a frame structure with high modulus of rigidity. The bending strength of such a unit in the horizontal plane depends on the bending strength of each rod 2, and particularly on the distance between these rods.

By increasing the number of the rods 2 and by placing them between the mounting plates 3, 7 in many planes, one can increase the modulus of rigidity of the whole device.

Figure 4:
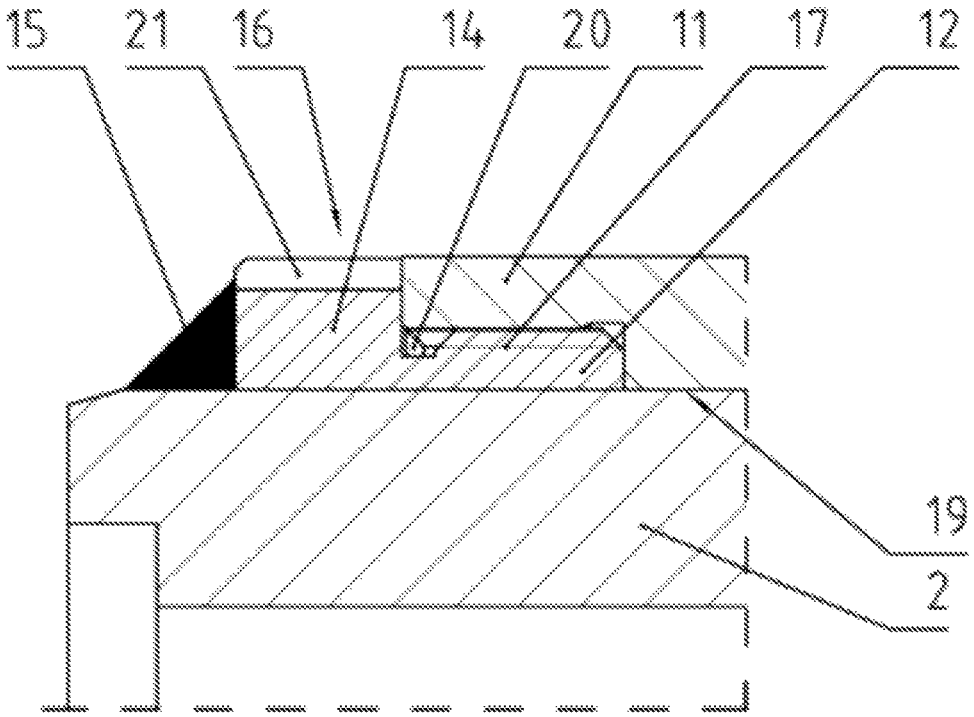
FIG. 4 shows an enlarged detail of the connection between the rod and the sleeve guiding part.
Figure 5:
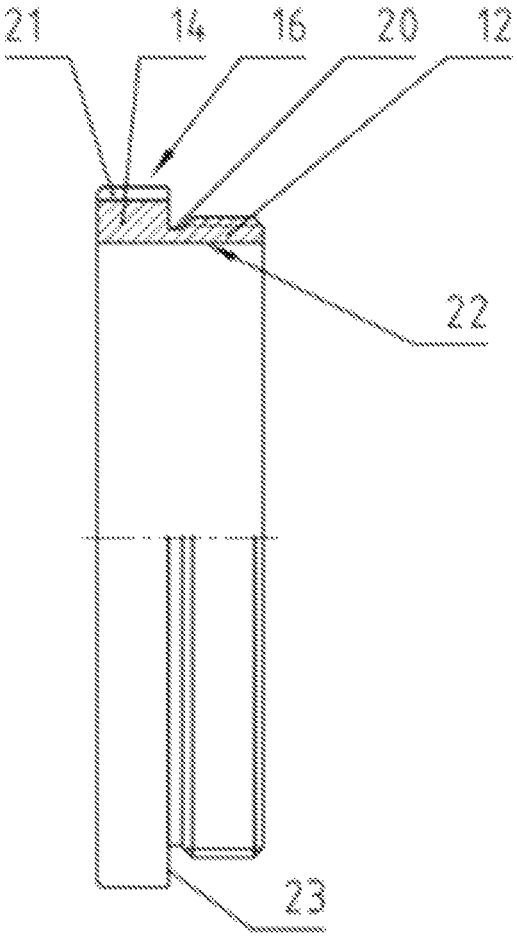
FIG. 5 presents the thrust ring with the safety intermediate element in a half section.

FIG. 4 presents the structural detail of the connection between the rod 2 and the sleeve guiding part 11. The rod 2 is mounted with play in the hole 19 of the sleeve guiding part 11, and at the same time the rod is secured against an axial shift relative to the sleeve guiding part 11 by means of the safety intermediate element 12 which is permanently connected with the rod 2. The safety intermediate element 12 is a sleeve with male thread, screwed into the female thread of the end of the sleeve guiding part 11. In addition, the safety intermediate element 12 is united with the thrust element 16 in the form of the thrust ring 14 welded to the end part of the rod 2. When the threshold impact force occurs causing the breaking of the safety intermediate elements 12, the kinetic energy starts to be absorbed by machining of the rod 2. This threshold impact force is therefore a function of the tension strength and the least cross-sectional area of the safety intermediate element 12. In order to determine this threshold force with more accuracy, an annular undercut 20 is shaped between the safety intermediate element 12 and the thrust ring 14. The structure of the thrust element 16 as a component, before installing in the device of the invention, is presented with more detail in FIG. 5. As shown in FIG. 4 and FIG. 5, the thrust ring 14 is connected by means of the annular undercut 20 with the safety intermediate element 12. A recess 21 on the circumference of the thrust ring is used to transfer the torque during the installation of the thrust element 16 in the sleeve guiding part 11. The thickness of the welded joint 15 permanently connecting the thrust ring 14 with the end part of the rod 2 is sufficient to transmit all possible forces acting on the device according to the invention, that is forces appearing during a crash, which compress the rod 2, as well as dynamic tractive forces which tension the rod 2. The internal hole 22 of the thrust element 16 is to be seated on the surface of the rod 2, so its diameter is the same as the diameter of the guiding hole 19 in the tool mounting plate. The outside diameter of the safety intermediate element 12 is adequately smaller than the outside diameter of the thrust ring 14 to provide a sufficient contact area 23 between that ring and the sleeve guiding part 11.

Figure 6A:
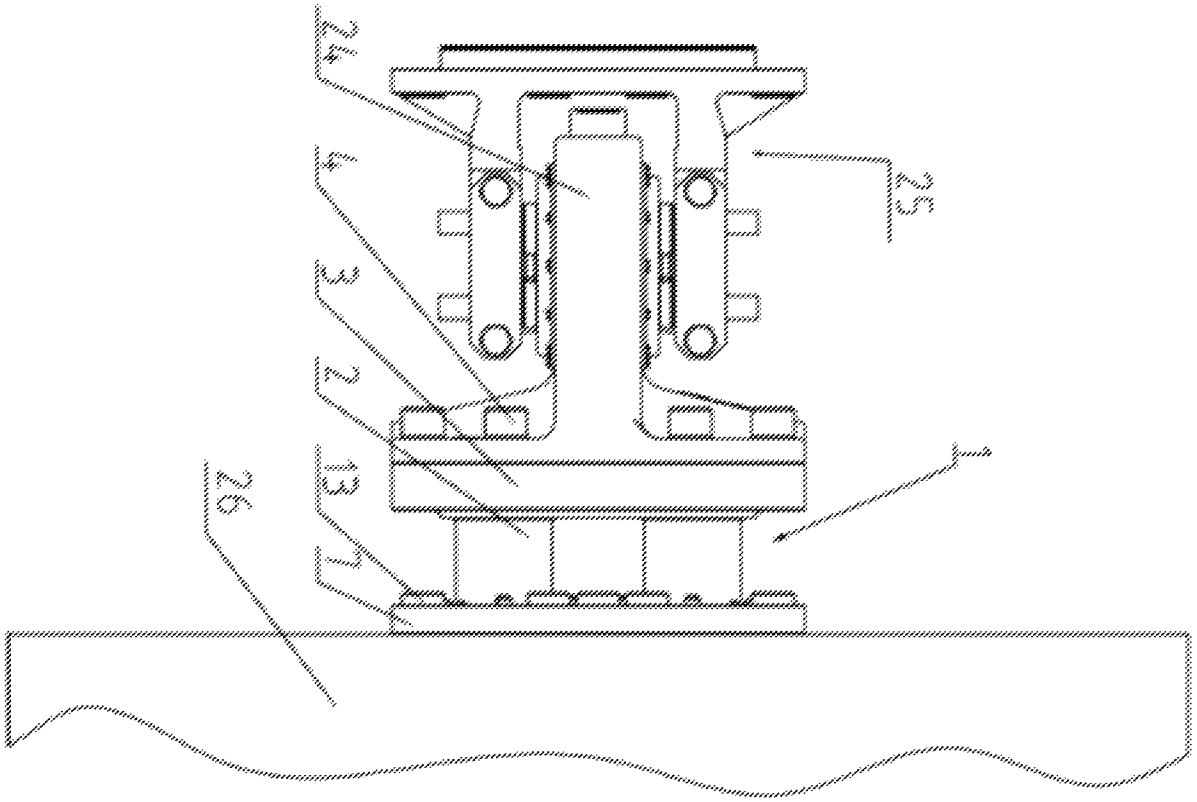
FIG. 6*a* presents the connection of the device of the invention with structural units of rail carriages in a schematic top view.
Figure 6B:
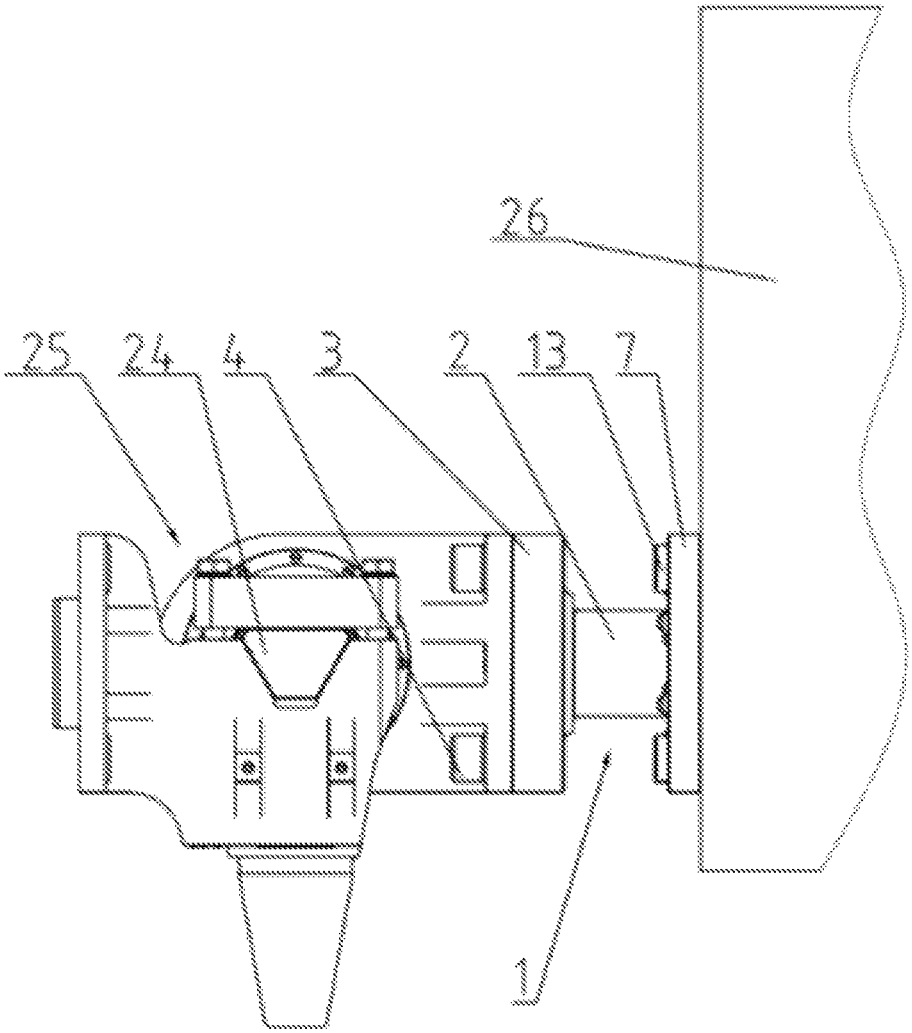
FIG. 6*b* presents the device of the invention with structural units of rail carriages in a schematic lateral view.

As shown in FIG. 6*a* and FIG. 6*b*, the mounting plate 3 is connected by means of bolts 4 with a joint 24 of a Jacobs bogie 25, and the tool mounting plate is connected by means of bolts 13 with a carbody load-bearing structure 26. The energy absorbing element 1 is made as two parallel rods 2 placed at a distance from one another which transmit the tensile stresses caused by the tractive force and at the same time are capable of absorbing the impact energy.

Figure 7:
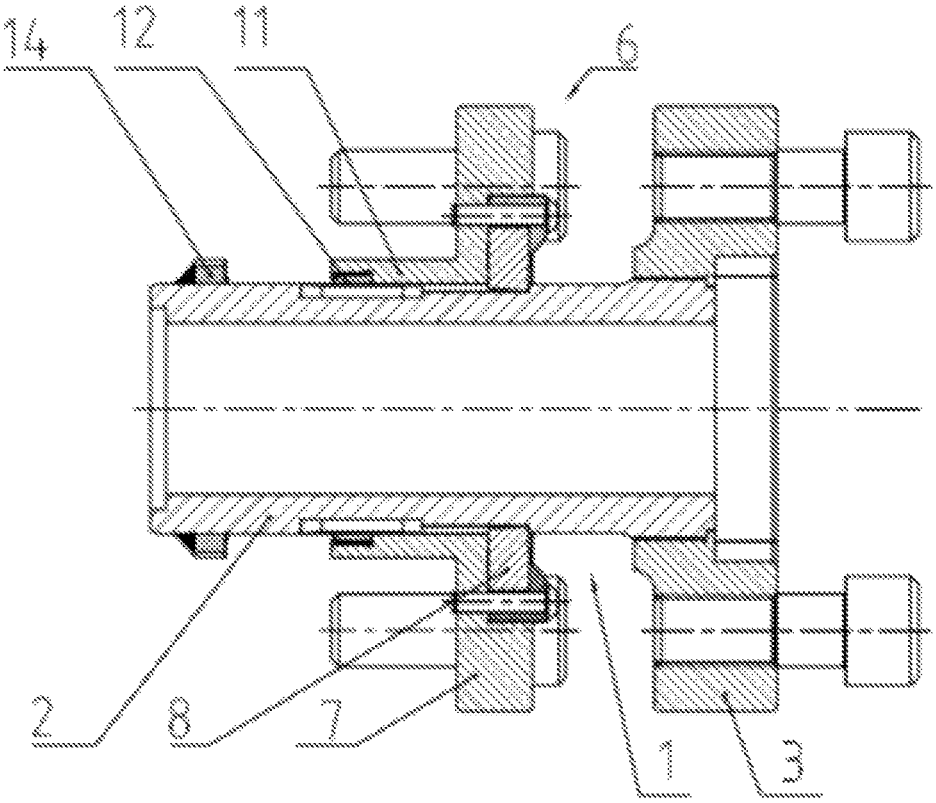
FIG. 7 shows the impact energy absorber at work.

FIG. 7 presents the device of the invention at the stage of absorbing the kinetic energy of impact. In case of the occurrence of the threshold force acting on the tool mounting plate 7 and pressing against the rod 2, the safety intermediate element 12 detaches from the welded thrust ring 14 in the area of the least cross-sectional area. This frees the machining unit 6 which travels along the axis of the rod 2 towards the mounting plate 3, and the cutting tools 8 machine the surface of the rod 2, thus absorbing the kinetic energy of impact. The parallel guiding of the tool mounting plate 7 relative to the mounting plate 3 is ensured by using the sleeve guiding part 11 slide-mounted on the rod 2.

LIST OF REFERENCE NUMBERS (FIGS. 1-7)

1—energy absorbing element
2—rod
3—mounting plate
4—bolts
5—threaded connection
6—machining unit
7—tool mounting plate
8—cutting tool
9—bolts
10—pressure elements
11—sleeve guiding part
12—safety intermediate element
13—bolts
14—thrust ring
15—welded joint
16—thrust element
17—thread
18—guiding undercuts
19—guiding hole
20—annular undercut
21—recess
22—internal hole
23—contact area
24—joint
25—Jacobs bogie
26—carbody load-bearing structure It will be readily apparent from the following description that there are numerous modifications and variations that are intended to be covered by the following claims.

The invention claimed is:

1. A device absorbing impact energy in structural units connecting rail vehicles, said device comprising:

an energy absorbing element, cutting tools which surround the energy absorbing element and are fastened in a machining unit movable parallel to the axes of selected parts of the energy absorbing element, at least one safety intermediate element which ensures the integrity of the connection between the energy absorbing element and the machining unit to a set threshold value of an applied impact force and allows an axial movement of the machining unit relative to the energy absorbing element when the set threshold value of the impact force has been exceeded, wherein the energy absorbing element comprises a set of at least two parallel machinable rods placed at a distance from one another, at least one thrust element used to transmit a tractive force between the machining unit and the rods, a tool mounting plate forming a part of the machining unit seated on the rods through guiding holes, and a mounting plate fastened to the rods and placed at a distance from the tool mounting plate.

2. The device according to claim 1, wherein the at least one thrust element is in contact with the machining unit and has a form of a thrust ring fastened to an end part of the rods.

3. The device according to claim 2, wherein the at least one thrust ring has at least one recess on its circumference.

4. The device according to claim 2, wherein the at least one thrust ring is welded to the end part of the rods.

5. The device according to claim 1, wherein the at least one thrust element is united with the at least one safety intermediate element coupled with the machining unit.

6. The device according to claim 5, wherein the at least one safety intermediate element is a threaded sleeve.

7. The device according to claim 5, further comprising an annular undercut between the at least one thrust element and the at least one safety intermediate element.

8. The device according to claim 1, wherein the machining unit has a sleeve guiding part united with the tool mounting plate.

9. The device according to claim 8, wherein the at least one safety intermediate element has a threaded connection with an end part of the sleeve guiding part of the machining unit.

10. The device according to claim 1, wherein the mounting plate is placed parallel to the tool mounting plate, and the mounting plate and tool mounting plates are seated on the opposite ends of the rods.

11. The device according to claim 1, wherein the mounting plate is seated on the rods by a threaded connection.

12. The device according to claim 1, wherein the rods are set perpendicular to the mounting plate and the tool mounting plate.

13. The device according to claim 1, wherein the mounting plate is adapted for connecting with a joint of a bogie supporting two neighboring rail carriages, and the tool mounting plate is adapted for connection with a carbody load-bearing structure.

14. The device according to claim 1, wherein the mounting plate and the tool mounting plate are substantially rectangular in shape.

15. The device according to claim 1, in which the rods are cylindrical.

* * * * *